US007401913B2

(12) United States Patent
Nishiberi et al.

(10) Patent No.: US 7,401,913 B2
(45) Date of Patent: Jul. 22, 2008

(54) RECORDING APPARATUS

(75) Inventors: Nozumu Nishiberi, Yokohama (JP); Kentaro Onuma, Yokohama (JP); Hiroyuki Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 450 days.

(21) Appl. No.: 11/136,463

(22) Filed: May 25, 2005

(65) Prior Publication Data

US 2005/0270353 A1 Dec. 8, 2005

(30) Foreign Application Priority Data

Jun. 4, 2004 (JP) ..... 2004-166676

(51) Int. Cl.
*B41J 2/01* (2006.01)

(52) U.S. Cl. ..... 347/104; 271/10.11; 271/10.12; 271/118; 271/119; 399/384; 400/624

(58) Field of Classification Search ..... None
See application file for complete search history.

(56) References Cited

U.S. PATENT DOCUMENTS

| | | | | |
|---|---|---|---|---|
| 4,992,805 | A * | 2/1991 | Yoshizawa et al. | 346/134 |
| 5,154,411 | A | 10/1992 | Saito et al. | 271/289 |
| 5,191,382 | A | 3/1993 | Okamura et al. | 355/309 |
| 5,502,464 | A * | 3/1996 | Takahashi et al. | 346/25 |
| 5,580,042 | A | 12/1996 | Taniguro et al. | 271/274 |
| 5,620,174 | A | 4/1997 | Taniguro et al. | 271/10.12 |
| 5,672,019 | A | 9/1997 | Hiramatsu et al. | 400/624 |
| 5,725,319 | A | 3/1998 | Saito et al. | 400/629 |
| 5,738,453 | A | 4/1998 | Tsuburaya et al. | 400/624 |
| 5,774,777 | A * | 6/1998 | Ohtsuka et al. | 399/384 |
| 5,794,927 | A * | 8/1998 | Uchida | 271/3.18 |
| 5,808,290 | A * | 9/1998 | Umeno | 235/475 |
| 5,899,613 | A | 5/1999 | Koike et al. | 399/384 |
| 5,902,058 | A | 5/1999 | Koike et al. | 400/578 |
| 5,918,873 | A | 7/1999 | Saito et al. | 271/10.11 |
| 6,168,270 | B1 | 1/2001 | Saikawa et al. | 347/104 |
| 6,305,682 | B1 | 10/2001 | Saito et al. | 271/10.11 |
| 6,609,709 | B2 | 8/2003 | Takahashi et al. | 271/115 |
| 6,685,370 | B2 | 2/2004 | Hiramatsu | 400/640 |
| 6,739,589 | B2 * | 5/2004 | Hiramatsu | 271/184 |
| 6,834,177 | B2 | 12/2004 | Saito et al. | 399/313 |
| 6,939,064 | B2 | 9/2005 | Kawaguchi et al. | 400/283 |
| 7,046,380 | B2 | 5/2006 | Nishiberi et al. | 358/1.12 |

(Continued)

FOREIGN PATENT DOCUMENTS

| | | |
|---|---|---|
| JP | 2002-87635 | 3/2002 |

(Continued)

*Primary Examiner*—Matthew Luu
*Assistant Examiner*—John P Zimmermann
(74) *Attorney, Agent, or Firm*—Fitzpatrick, Cella, Harper & Scinto

(57) ABSTRACT

A conveying roller and a paper expelling roller provided upstream and downstream, respectively, of a recording portion in a conveyance direction are connected via an idler gear so as to be able to perform drive transmission, a rotation drive amount of the idler gear is detected, ends of a recording medium in the conveyance direction are detected, driving of a conveying motor is controlled based on detection signals of the rotation drive amount of the idler gear and the ends of the recording medium, and a control constant is made variable according to a position of the recording medium in the conveyance direction.

12 Claims, 3 Drawing Sheets

U.S. PATENT DOCUMENTS

| | | | | |
|---|---|---|---|---|
| 7,284,918 | B2 | 10/2007 | Nunokawa | 400/56 |
| 7,303,345 | B2 * | 12/2007 | Bedzyk et al. | 400/625 |
| 2002/0163568 | A1 * | 11/2002 | Takeishi | 347/101 |
| 2004/0041331 | A1 | 3/2004 | Sonoda et al. | 271/121 |
| 2004/0052565 | A1 | 3/2004 | Takeishi et al. | 400/283 |
| 2004/0141021 | A1 * | 7/2004 | Yamamoto et al. | 347/16 |
| 2005/0270353 | A1 | 12/2005 | Nishiberi et al. | 347/104 |
| 2006/0023050 | A1 | 2/2006 | Nishiberi et al. | 347/104 |
| 2006/0024118 | A1 | 2/2006 | Niikura et al. | 400/691 |

FOREIGN PATENT DOCUMENTS

| | | |
|---|---|---|
| JP | 2002-154197 | 5/2002 |
| JP | 2002-225368 | 8/2002 |
| JP | 2003-23784 | 1/2003 |
| JP | 2003-65798 | 3/2003 |
| JP | 2004-58526 | 2/2004 |
| JP | 2004-123313 | 4/2004 |

* cited by examiner

RECORDING APPARATUS

BACKGROUND OF THE INVENTION

1. Field of the Invention

The present invention relates to a recording apparatus for recording on a recording medium conveyed by a conveying mechanism portion using recording means.

2. Related Background Art

As output apparatuses of various information processing apparatuses including personal computers, recording apparatuses have been used for recording on a recording medium using recording means based on recording information, such as printers, image forming apparatuses, facsimiles, or copiers. The recording apparatuses are classified into thermal transfer recording apparatuses, inkjet recording apparatuses, laser recording apparatuses, wire dot recording apparatuses, or the like according to the kinds of the recording apparatuses. The recording apparatuses are adapted for recording on a recording medium conveyed by a conveying mechanism portion, and classified into apparatuses of a serial type for recording while performing main scanning of a recording medium using recording means and apparatuses of a line type for recording by conveyance (sub scanning) of a recording medium, according to the recording type.

In the conveying mechanism portion in the recording apparatus, higher conveyance accuracy in conveying the recording medium and a quieter conveying operation have been required. In recent years, images recorded on a recording medium have been including pictures rather than text only, which has been requiring higher and higher conveyance accuracy of the conveying mechanism portion. Such a technique for improving conveyance accuracy is disclosed in, for example, U.S. Pat. No. 6,685,370.

The conveying mechanism portion in the conventional recording apparatus has the following problems. First, in order to reduce conveyance resolution of the conveying mechanism portion to increase resolution, either a method of reducing a diameter of a conveying roller or a method of providing finer resolution of a code wheel provided coaxially with the conveying roller needs to be used. However, the method of reducing the diameter of the conveying roller makes it difficult to ensure conveyance accuracy, and thus either a method of increasing a diameter of the code wheel to increase the resolution or a method of increasing resolution of an encoder only can be used, both of which increase costs. Increasing the diameter of the code wheel increases the size of the apparatus.

Second, reducing the conveyance resolution to increase the resolution may affects a reduction ratio from a conveying motor to the conveying roller to prevent an optimum RPM of the motor or optimum motor torque from being chosen in selecting the conveying motor. Further, variations of conveyance distances or conveyance accuracy differ among conveyance of the recording medium by the conveying roller only (recording on a leading end of the recording medium), conveyance of the recording medium by the conveying roller and a paper expelling roller (recording on the center of the recording medium), and conveyance of the recording medium by the paper expelling roller only (recording on a rear end of the recording medium).

SUMMARY OF THE INVENTION

The present invention has been achieved in view of the above described technical problems, and has an object to provide a recording apparatus that is compact and inexpensive, and can improve conveyance accuracy of a recording medium in a conveying mechanism portion.

In order to achieve the above described object, the present invention provides a recording apparatus for recording on a recording medium conveyed by conveying means using recording means including: first conveying means provided upstream of a recording portion; second conveying means provided downstream of the recording portion; drive transmitting means for connecting the first conveying means and the second conveying means so as to be able to perform drive transmission; and drive amount detecting means for detecting a drive amount of the drive transmitting means.

In order to achieve the above described object, the present invention also provides a recording apparatus for recording on a recording medium conveyed by conveying means using recording means including: first conveying means provided upstream of a recording portion; second conveying means provided downstream of the recording portion; drive means; first drive transmitting means for connecting the drive means and the first conveying means so as to be able to perform drive transmission; second drive transmitting means for connecting the first conveying means and the second conveying means so as to be able to perform drive transmission; and drive amount detecting means for detecting a drive amount of the second drive transmitting means.

According to the present invention, the drive amount detecting means is provided for detecting the drive amount of the drive transmitting means for connecting the conveying means provided upstream of the recording portion and the conveying means provided downstream of the recording portion so as to be able to perform drive transmission. Thus, a control constant of the drive means is made variable according to a position of the recording medium, thereby providing a compact and inexpensive apparatus, improving conveyance accuracy of the recording medium in the conveying mechanism portion, and improving image quality of a recorded image.

DESCRIPTION OF THE PREFERRED EMBODIMENTS

Figure 1:
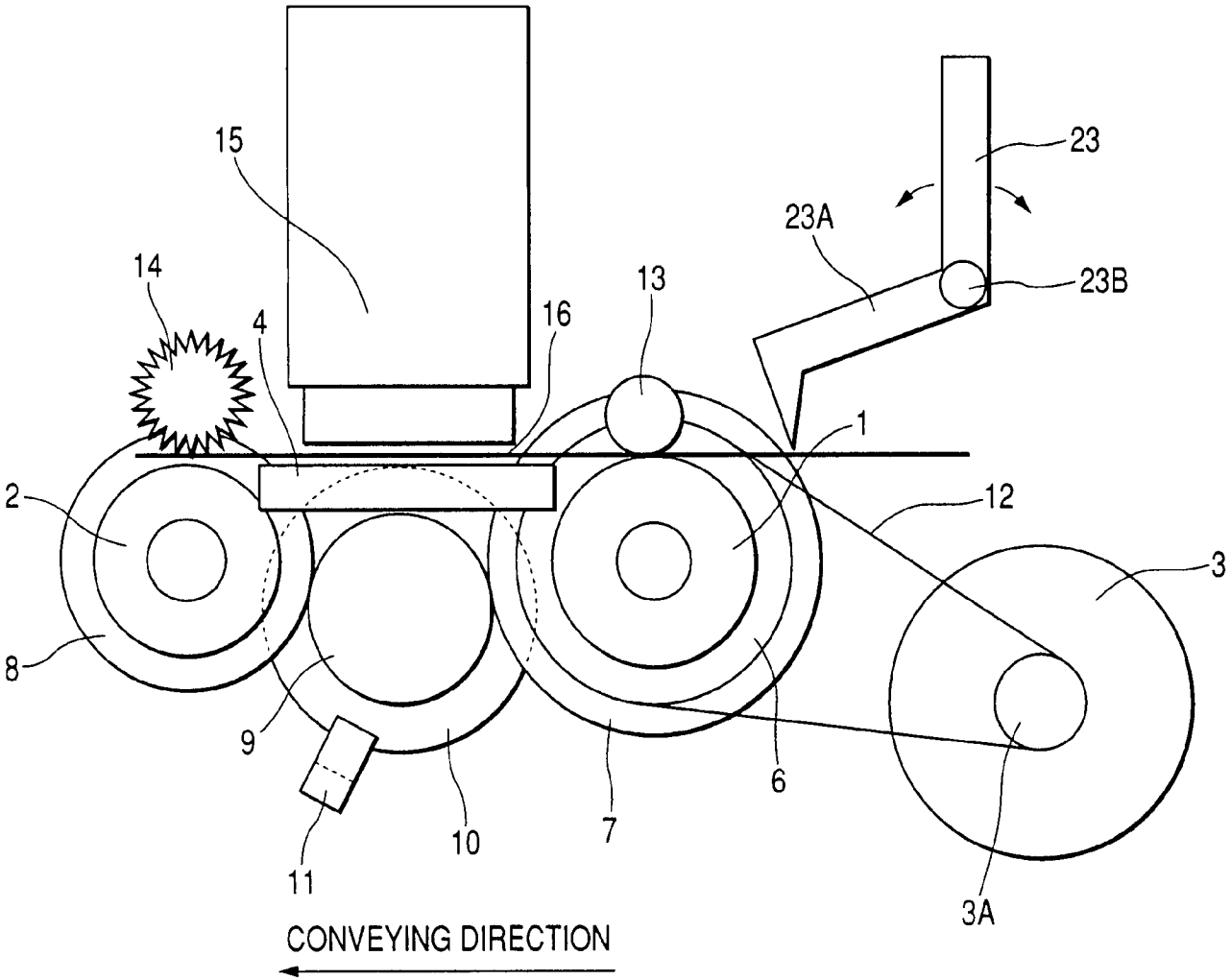
FIG. 1 is a schematic side view of essential portions of a recording apparatus according to an embodiment of the present invention.
Figure 2:
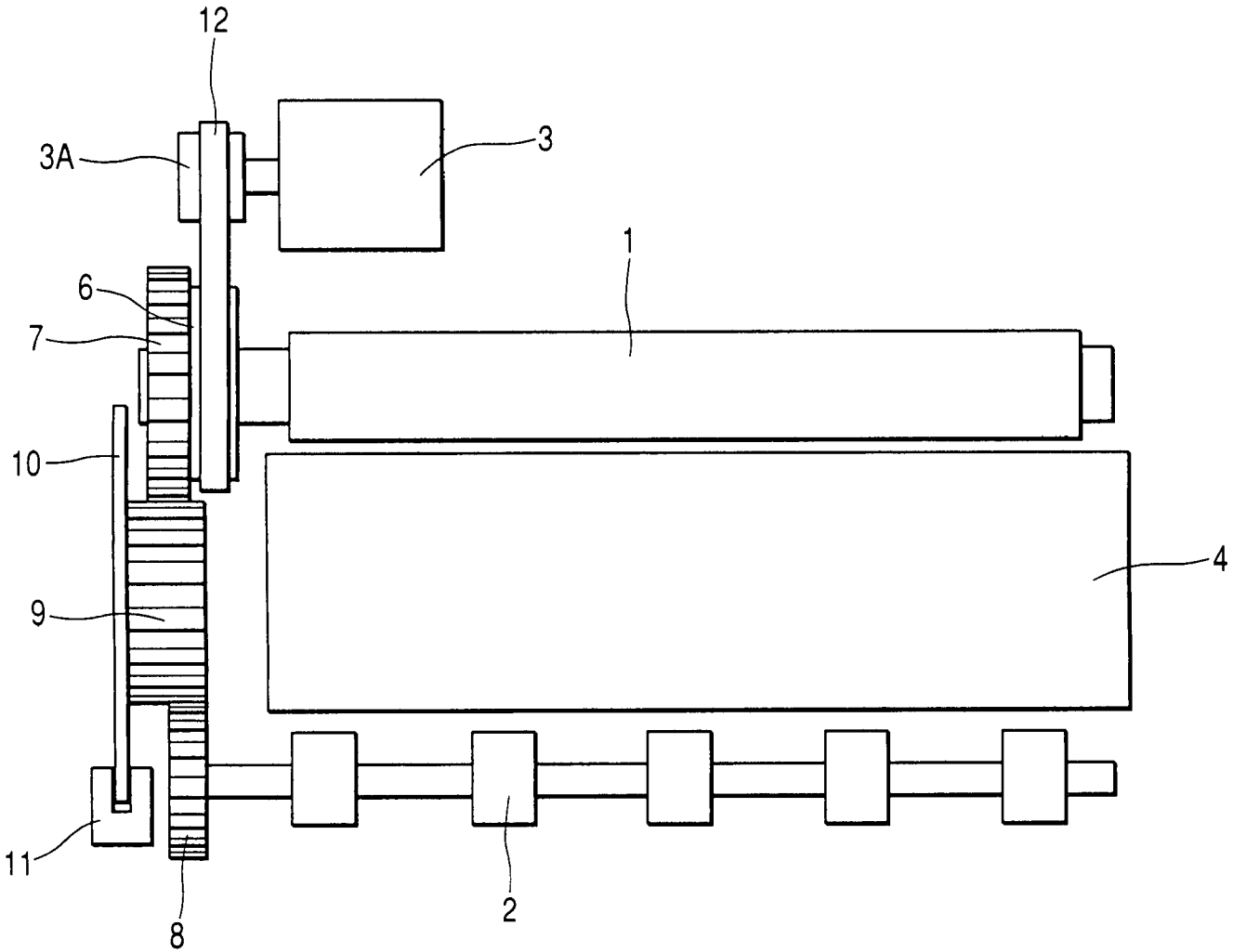
FIG. 2 is a schematic plan view of a configuration on a lower side from a recording medium of the recording apparatus in FIG. 1.
Figure 3:
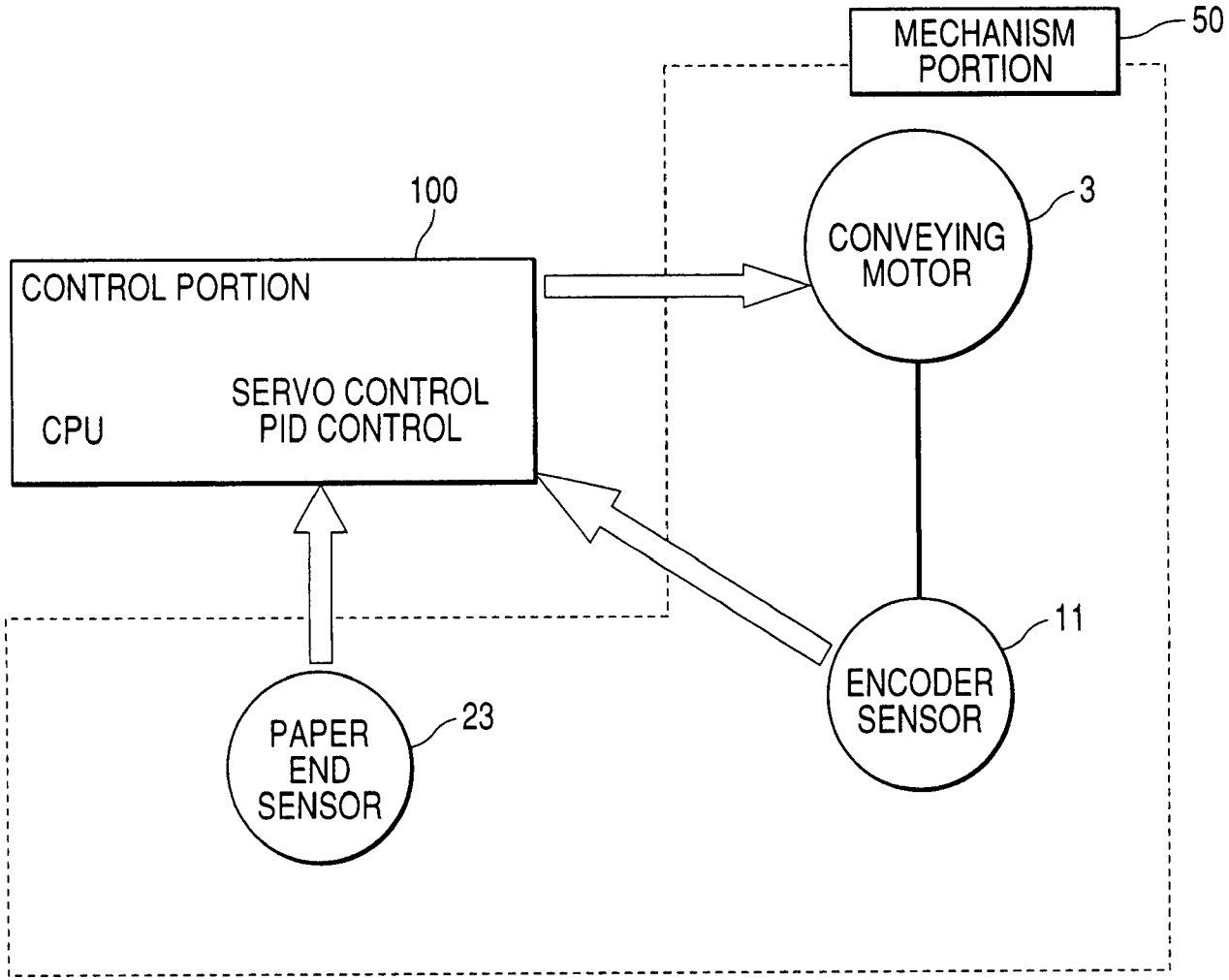
FIG. 3 is a block diagram of a control system of the recording apparatus in FIG. 1.

Now, an embodiment of the present invention will be described in detail with reference to the drawings. The same reference numerals denote the same or corresponding parts throughout the drawings. FIG. 1 is a schematic side view of essential portions of a recording apparatus according to an embodiment of the present invention, FIG. 2 is a schematic plan view of a configuration on a lower side from a recording medium of the recording apparatus in FIG. 1, and FIG. 3 is a block diagram of a control system of the recording apparatus in FIG. 1. In FIGS. 1 and 2, reference numeral 1 denotes a conveying roller (an LF roller) as conveying means (a first conveying roller) provided upstream of a recording portion (upstream in a conveyance direction), which is constituted by a metal roller coated with alumina powder with urethane resin or the like in the embodiment.

Reference numeral 13 denotes a pinch roller, which is pressed on the conveying roller 1 by unshown urging means to form a nip portion that provides a conveying force to a recording medium 16 such as paper or a plastic plate. Reference numeral 4 denotes a platen, which constitutes a guide member that guides the recording medium 16 in recording on the recording medium 16 by a recording head 15 as recording means. Reference numeral 2 denotes a paper expelling roller as conveying means (a second conveying roller) provided downstream of the recording portion (downstream in the conveyance direction), which is constituted by a roller with rubber pressed into a metal shaft in the embodiment. Reference numeral 14 denotes a spur, which is pressed on the paper expelling roller 2 by an unshown spur spring to produce a conveying force of the recording medium 16.

Reference numeral 3 denotes a conveying motor as drive means of a conveying mechanism portion, and a DC motor is used in the embodiment. Reference numeral 3A denotes a conveying motor pulley provided on an output shaft of the conveying motor 3. Reference numeral 6 denotes a conveying roller pulley provided on a shaft of the conveying roller 1, and reference numeral 7 denotes a conveying roller gear provided on the shaft of the conveying roller 1. Reference numeral 12 denotes a conveying drive belt, which performs drive transmission between the conveying motor pulley 3A and the conveying roller pulley 6. The conveying drive belt 12 constitutes drive transmitting means for connecting the conveying motor 3 as the drive means and the conveying roller 1 as the conveying means provided upstream of the recording portion in the conveyance direction so as to be able to perform drive transmission.

Reference numeral 8 denotes a paper expelling roller gear provided on a shaft of the paper expelling roller 2, and reference numeral 9 denotes an idler gear (a drive transmitting rotary member) that performs drive transmission between the conveying roller gear 7 and the paper expelling roller gear 8. Reference numeral 10 denotes a disk-shaped code wheel provided coaxially and integrally with the idler gear 9, and codes such as slits or marks are formed at a predetermined pitch angle on a perimeter of the code wheel 10. Reference numeral 11 denotes an encoder sensor for detecting the slits or the marks on the code wheel 10. The paper expelling roller 2 constitutes the conveying means provided downstream of the recording portion in the conveyance direction.

The idler gear 9 constitutes drive transmitting means for connecting the first conveying means (the conveying roller 1) provided upstream of the recording portion and the second conveying means (the paper expelling roller 2) provided downstream of the recording portion so as to be able to perform drive transmission. The code wheel 10 and the encoder sensor 11 constitute drive amount detecting means for detecting a drive amount of the drive transmitting means. Further, the conveying motor 3 constitutes drive means for driving the first conveying means (the conveying roller 1) provided upstream of the recording portion.

Next, stop resolution of the conveying roller 1 and the size of the code wheel 10 in the recording apparatus according to the embodiment will be described. In the embodiment having the above described configuration, d is equal to $D \times p/300 \times 1/Z$ for the encoder sensor 11 with 300 DPI, where D (inch) is the diameter of the conveying roller 1, p is the stop resolution (resolution per inch) of the conveying roller 1, Z is a reduction ratio between the conveying roller gear 7 and the idler gear 9 (the pitch diameter of the idler gear 9 is smaller), and d is the pitch diameter of the code wheel 10. Thus, d becomes $\phi 24$ mm when D is $\phi 12$ mm, p is 1800 DPI, and Z is 3. On the other hand, in a configuration with a code wheel provided on a shaft of a conveying roller 1 as in a conventional example, the value of Z in the above expression becomes 1, and thus d becomes 72 mm.

As is apparent therefrom, with the same diameter D of the conveying roller 1 and the same stop resolution p of the conveying roller 1, the diameter of the code wheel 10 in the embodiment can be significantly smaller than the diameter of the code wheel in the conventional recording apparatus. Specifically, according to the embodiment, the code wheel 10 is provided coaxially with a gear (the idler gear 9) adjacent to a gear (the conveying roller gear 7) on the shaft of the conveying roller 1, and the pitch diameter of the idler gear 9 is adapted to be smaller than the pitch diameter of the conveying roller gear 7, thereby providing a compact recording apparatus without reducing resolution of a recorded image on the recording medium 16.

In the embodiment, a reduction ratio between the conveying motor pulley 3A and the conveying roller pulley 6 is set to k. The value of k can be set according to a torque characteristic or a cogging pitch of the conveying motor 3, or the like, independently of the value of the reduction ratio Z between the conveying roller gear 7 and the idler gear 9. Further, the paper expelling roller gear 8 integral with the paper expelling roller 2 is directly in mesh with the idler gear 9 integral with the code wheel 10 that is a subject to control, thereby improving conveyance accuracy of the paper expelling roller 2.

In FIG. 1, reference numeral 23 denotes a paper end sensor for detecting positions of a leading end and a rear end of the recording medium 16 to be conveyed. The shown paper end sensor 23 is adapted so that a sensor arm 23A rotates around a shaft 23B in a predetermined direction when the leading end and the rear end of the recording medium 16 pass to detect the leading end and the rear end of the recording medium 16. FIG. 3 shows a control portion 100 as control means and a mechanism portion 50 relating to a control operation in the embodiment. The control portion 100 controls driving of the conveying motor 3 based on detection signals from the encoder sensor 11 and the paper end sensor 23. Specifically, the control portion 100 drives the conveying motor 3 while counting code reading signals from the encoder sensor 11 at each recording by the recording head 15, and stops the motor based on the count value to convey the recording medium 16 a predetermined distance.

In a control system of the conveying motor 3 according to the embodiment, a CPU is used to perform servo control based on PID control. The paper end sensor 23 constitutes recording medium detecting means for detecting ends (the leading end and the rear end in the embodiment) of the recording medium 16 in the conveyance direction. The control portion 100 constitutes control means for controlling the drive means (the drive motor) 3 based on the signals from the drive amount detecting means 10 and 11 and the recording medium detecting means 23.

In the control of the conveying motor 3, the position of the leading end of the recording medium 16 is detected by the paper end sensor 23 to distinguish between conveyance of the recording medium 16 by the conveying roller 1 only (recording on the leading end of the recording medium) and conveyance of the recording medium 16 by the conveying roller 1 and the paper expelling roller 2 (recording on the center of the recording medium). The code wheel 10 with the idler gear 9 that is the subject to control is directly connected to both the conveying roller 1 and the paper expelling roller 2, and thus a stop error of the idler gear 9 differs according to a difference in conveyance load between the recording on the leading end of the recording medium and the recording on the center thereof.

Thus, in the embodiment, in servo control of the conveying motor 3 based on the PID control, a conveyance error according to a difference in recording position can be corrected by changing a control constant (a servo constant) of the conveying motor 3 between the recording on the leading end of the recording medium 16 and the recording on the center thereof. Specifically, a control constant is made variable according to the position of the recording medium 16 in the conveyance direction.

In the control of the conveying motor 3, the position of the rear end of the recording medium 16 is detected by the paper end sensor 23 to distinguish between conveyance of the recording medium 16 by the conveying roller 1 and the paper expelling roller 2 (recording on the center of the recording medium) and conveyance of the recording medium 16 by the paper expelling roller 2 only (recording on the rear end of the recording medium). The code wheel 10 with the idler gear 9 that is the subject to control is directly connected to both the conveying roller 1 and the paper expelling roller 2, and thus a stop error of the idler gear 9 differs according to a difference in conveyance load between the recording on the center of the recording medium and the recording on the rear end thereof. Also in this case, in servo control of the conveying motor 3 based on the PID control, a conveyance error according to a difference in recording position can be corrected by changing a control constant (a servo constant) of the conveying motor 3 between the recording on the center of the recording medium 16 and the recording on the rear end thereof. Thus, also in this case, a control constant is made variable according to the position of the recording medium 16 in the conveyance direction.

For example, a relational expression between a servo constant 1 and a pulse count value of the encoder sensor in the conveyance of the recording medium 16 by both the conveying roller 1 and the paper expelling roller 2 is the following: motor drive PWM value=function (servo constant 1, (target value·pulse count number)).

A relational expression of a servo constant 2 in the conveyance of the recording medium by the conveying roller 1 only is the following: motor drive PWM value=function (servo constant 2, (target value·pulse count number)).

A relational expression of a servo constant 3 in the conveyance of the recording medium by the conveying roller 1 only is the following: motor drive PWM value=function (servo constant 3, (target value·pulse count number)).

Specifically, in the conveyance of the recording medium 16 by both the conveying roller 1 and the paper expelling roller 2, the driving of the conveying motor 3 at each recording by the recording head is controlled to stop when the code reading signal from the encoder sensor 11 reaches a first count value. Then, after the leading end of the recording medium passes through the conveying roller 1, the conveying motor 3 is controlled to stop when the code reading signal from the encoder sensor 11 reaches a second count value different from the first count value at each recording by the recording head 15. When the conveying speed of the paper expelling roller 2 is higher than the conveying speed of the conveying roller 1, the first count value is larger than the second count value. This tendency is prominent when a slip of the conveying roller on the recording medium is greater than a slip of the paper expelling roller on the recording medium.

In the conveyance of the recording medium by the conveying roller only, the conveying motor 3 is controlled to stop when the code reading signal from the encoder sensor 11 reaches a third count value different from the first count value at each recording by the recording head 15. When the conveying speed of the paper expelling roller 2 is higher than the conveying speed of the conveying roller 1, the first count value is smaller than the third count value.

According to the above described embodiment, the drive amount detecting means (the code wheel 10 and the encoder sensor 11) is provided for detecting the drive amount of the drive transmitting means (the idler gear 9) for connecting the conveying means (the conveying roller 1) provided upstream of the recording portion and the conveying means (the paper expelling roller 2) provided downstream of the recording portion so as to be able to perform drive transmission. Thus, the control constant of the drive means (the conveying motor 3) is made variable according to the position of the recording medium 16, thereby providing a compact and inexpensive apparatus, improving conveyance accuracy of the recording medium 16 in the conveying mechanism portion, and improving image quality of a recorded image.

In the embodiment, the drive transmitting means between the conveying motor 3 and the conveying roller 1 is constituted by the conveying drive belt 12 such as a timing belt, but may be constituted by a gear. Also, drive transmitting means connected by a timing belt or the like may be used instead of the drive transmitting means constituted by the conveying roller gear 7, the idler gear 9 and the paper expelling roller gear 8. Such a configuration also provides a recording apparatus having advantages similar to the advantages in the above described embodiment.

The present invention may be similarly applied to recording apparatuses of various recording types as long as the recording apparatuses include a conveying mechanism portion for conveying a recording medium, such as a recording apparatus of a serial recording type for recording while moving recording means relative to a recording medium, or a recording apparatus of a line recording type for recording by sub scanning only using recording means of a line time having a length that covers the whole or part of the width of a recording medium, and similar advantages may be achieved. The present invention may be similarly applied to a recording apparatus using one recording means, a color recording apparatus using a plurality of recording means for recording in different color ink, a gradation recording apparatus using a plurality of recording means for recording in the same color and different densities, and a recording apparatus of a combination thereof, and similar advantages may be achieved.

Further, when applied to an inkjet recording apparatus, the present invention may be similarly applied to any arrangement of recording means and an ink tank such as an arrangement using a changeable ink cartridge with recording means and an ink tank being integrated, or an arrangement of separate recording means and ink tank connected by an ink supply tube or the like, and similar advantages may be achieved. When applied to an inkjet recording apparatus, the present invention may be applied to an apparatus using recording means with an electromechanical converting member such as a piezoelectric element. In particular, significant advantages may be achieved in an inkjet recording apparatus using recording means of a type using thermal energy to discharge ink. The recording means of such a type achieves recording with higher density and higher definition.

This application claims priority from Japanese Patent Application No. 2004-166676 filed on Jun. 4, 2004, which is hereby incorporated by reference herein.

What is claimed is:

1. A recording apparatus for recording on a recording medium conveyed by a conveying mechanism portion using recording means, comprising:

first conveying means provided upstream of a recording portion;

second conveying means provided downstream of said recording portion;

drive transmitting means for connecting said first conveying means and said second conveying means so as to be able to perform drive transmission, wherein said drive transmitting means has a first gear provided on a rotational shaft of said first conveying means, a second gear provided on a rotational shaft of said second conveying means and a third gear engageable with the second gear; and drive amount detecting means for detecting a drive amount of said drive transmitting means, wherein said drive amount detecting means detects a rotating amount of the third gear and is not located on the rotational shaft of the first conveying means or the rotational shaft of the second conveying means.

2. The recording apparatus according to claim 1, further comprising:

drive means for driving said first conveying means;

recording medium detecting means for detecting ends of said recording medium in a conveyance direction; and control means for controlling said drive means based on signals from said drive amount detecting means and said recording medium detecting means, wherein a control constant is made variable according to a position of said recording medium in the conveyance direction.

3. A recording apparatus for recording on a recording medium conveyed by a conveying mechanism portion using recording means comprising:

first conveying means provided upstream of a recording portion;

second conveying means provided downstream of said recording portion; drive means;

first drive transmitting means for connecting said drive means and said first conveying means so as to be able to perform drive transmission;

second drive transmitting means for connecting said first conveying means and said second conveying means so as to be able to perform drive transmission, wherein said second drive transmitting means has a first gear provided on a rotational shaft of said first conveying means, a second gear provided on a rotational shaft of said second conveying means and a third gear engageable with the second gear;

and drive amount detecting means for detecting a drive amount of said second drive transmitting means, wherein said drive amount detecting means detects a rotation amount of the third gear and is not located on the rotational shaft of the first conveying means or the rotational shaft of the second conveying means.

4. The recording apparatus according to claim 3, further comprising:

recording medium detecting means for detecting ends of said recording medium in a conveyance direction; and control means for controlling said drive means based on signals from said drive amount detecting means and said recording medium detecting means, wherein a control constant is made variable according to a position of said recording medium in the conveyance direction.

5. A recording apparatus for recording on a recording medium using recording means for recording by discharging ink, comprising:

a first conveying roller provided upstream of said recording means;

a second conveying roller provided downstream of said recording means;

a drive transmitting rotary member for connecting said first conveying roller and said second conveying roller so as to be able to perform drive transmission, wherein said drive transmitting rotary member rotates around a rotation shaft different from either of the rotational shaft of said first conveying roller or the rotational shaft of said second conveying roller;

a motor for driving said first conveying roller;

a code wheel provided coaxially with said drive transmitting rotary member, and an encoder sensor for reading codes on said code wheel; and control means for controlling said motor based on code reading signals from said encoder sensor.

6. The recording apparatus according to claim 5, wherein said control means drives said motor while counting code reading signals from said encoder sensor at each recording by said recording means, and stops said motor based on the count value.

7. The recording apparatus according to claim 6, wherein in conveyance of the recording medium by both said first conveying roller and said second conveying roller, said control means stops driving of said motor at each recording by said recording means when the code reading signal from said encoder sensor reaches a first count value, and after the recording medium passes through said first conveying roller, said control means stops the driving of said motor at each recording by said recording means when the code reading signal from said encoder sensor reaches a second count value different from the first count value.

8. The recording apparatus according to claim 6, wherein in conveyance of the recording medium by both said first conveying roller and said second conveying roller, said control means stops driving of said motor at each recording by said recording means when the code reading signal from said encoder sensor reaches a first count value, and in conveyance of the recording medium by said first conveying roller only, said control means stops the driving of said motor at each recording by said recording means when the code reading signal from said encoder sensor reaches a third count value different from the first count value.

9. A recording apparatus for recording on a recording medium using recording means for recording by discharging ink, comprising:

a first conveying roller provided upstream of said recording means;

a second conveying roller provided downstream of said recording means;

drive transmitting means for transmitting a drive force from said first conveying roller to said second conveying roller, said drive transmitting means having a first gear provided coaxially with said first conveying roller and an idler gear engageable with the first gear to transmit the drive force to said second conveying roller;

a motor for driving said first conveying roller;

a code wheel provided coaxially with the idler gear;

an encoder sensor for reading codes on said code wheel; and control means for controlling said motor based on code reading signals from said encoder sensor, wherein a pitch diameter of the idler gear is smaller than a pitch diameter of the first gear.

10. The recording apparatus according to claim 9, wherein said control means drives said motor while counting code reading signals from said encoder sensor at each recording by said recording means, and stops said motor based on the count value.

11. The recording apparatus according to claim 10, wherein in conveyance of the recording medium by both said first conveying roller and said second conveying roller, said control means stops driving of said motor at each recording by said recording means when the code reading signal from said encoder sensor reaches a first count value, and after the recording medium passes through said first conveying roller, said control means stops the driving of said motor at each recording by said recording means when the code reading signal from said encoder sensor reaches a second count value different from the first count value.

12. The recording apparatus according to claim 11, wherein said second conveying roller has a conveying speed faster than said first conveying roller and the first count value is greater than the second count value.

* * * * *

UNITED STATES PATENT AND TRADEMARK OFFICE

CERTIFICATE OF CORRECTION

PATENT NO. : 7,401,913 B2
APPLICATION NO. : 11/136463
DATED : July 22, 2008
INVENTOR(S) : Nishiberi et al.

It is certified that error appears in the above-identified patent and that said Letters Patent is hereby corrected as shown below:

COLUMN 1:
Line 50, “affects” should read --affect--.

COLUMN 7:
Line 45, “gear;” should read --gear; and--.
Line 46, “and” should be deleted.

Signed and Sealed this

Third Day of February, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,401,913 B2
APPLICATION NO. : 11/136463
DATED : July 22, 2008
INVENTOR(S) : Nishiberi et al.

It is certified that error appears in the above-identified patent and that said Letters Patent is hereby corrected as shown below:

ON THE TITLE PAGE:
At Item 75, Inventors, "Nozumu Nishiberi, Yokohama (JP);" should read --Nozomu Nishiberi, Yokohama (JP)--.

Signed and Sealed this

Ninth Day of June, 2009

JOHN DOLL
*Acting Director of the United States Patent and Trademark Office*